US009683789B2

(12) United States Patent
Siverklev

(10) Patent No.: US 9,683,789 B2
(45) Date of Patent: Jun. 20, 2017

(54) METHOD OF PRODUCING MULTIPLE CHANNELS FOR USE IN A DEVICE FOR EXCHANGE OF SOLUTES OR HEAT BETWEEN FLUID FLOWS

(75) Inventor: Johan Siverklev, Härryda (SE)

(73) Assignee: Air to Air Sweden AB, Lund (SE)

( * ) Notice: Subject to any disclaimer, the term of this patent is extended or adjusted under 35 U.S.C. 154(b) by 524 days.

(21) Appl. No.: 13/511,662

(22) PCT Filed: Nov. 24, 2010

(86) PCT No.: PCT/SE2010/051298

§ 371 (c)(1),
(2), (4) Date: Jul. 5, 2012

(87) PCT Pub. No.: WO2011/065906

PCT Pub. Date: Jun. 3, 2011

(65) Prior Publication Data

US 2012/0285671 A1 Nov. 15, 2012

Related U.S. Application Data

(63) Continuation-in-part of application No. 12/624,612, filed on Nov. 24, 2009, now abandoned.

(30) Foreign Application Priority Data

Nov. 24, 2009 (SE) ..... 0950889

(51) Int. Cl.
*F28D 21/00* (2006.01)
*F28D 9/00* (2006.01)
(Continued)

(52) U.S. Cl.
CPC ..... *F28D 21/0015* (2013.01); *F28D 9/0031* (2013.01); *F28F 3/046* (2013.01);
(Continued)

(58) Field of Classification Search
CPC ..... F28D 9/0037; F28D 9/0031; F28F 3/086; F28F 3/12
(Continued)

(56) References Cited

U.S. PATENT DOCUMENTS 1,861,292 A * 5/1932 Barrett ..... 165/117
3,845,814 A * 11/1974 Kun ..... 165/148
(Continued)

FOREIGN PATENT DOCUMENTS

DE 2044817 7/1972
DE 2044817 A1 7/1972
(Continued)

OTHER PUBLICATIONS

Second Office Action corresponding to Chinese Application No. 201080060727.9, issued Jun. 27, 2014.
(Continued)

*Primary Examiner* — Justin Jonaitis
*Assistant Examiner* — Joel Attey
(74) *Attorney, Agent, or Firm* — Myers Bigel, P.A.

(57) ABSTRACT

The present invention relates to a method of producing multiple channels for use in a device for exchange of solutes between at least two fluid flows. The invention further relates to such a device. At least a first and a second sheet are comprised. The method comprises the steps of providing at least one of the first and second sheets with at least one profiled surface and joining the first and second sheets together with the profiled surfaces facing against each other. Channels are formed by the shape of the profiled surfaces.

12 Claims, 14 Drawing Sheets

(51) Int. Cl.

| | |
|---|---|
| ***F28F 3/04*** | (2006.01) |
| ***F28F 13/08*** | (2006.01) |
| ***F28F 13/12*** | (2006.01) |
| ***F28F 3/08*** | (2006.01) |
| ***F28F 3/12*** | (2006.01) |

(52) U.S. Cl.
CPC ..... *F28F 13/08* (2013.01); *F28D 9/0037* (2013.01); *F28F 3/086* (2013.01); *F28F 3/12* (2013.01); *F28F 13/12* (2013.01); *F28F 2245/02* (2013.01); *F28F 2245/04* (2013.01); *Y10T 29/4935* (2015.01); *Y10T 29/49826* (2015.01); *Y10T 137/8593* (2015.04)

(58) Field of Classification Search
USPC ..... 165/164, 170, 166
See application file for complete search history.

(56) References Cited

U.S. PATENT DOCUMENTS

| | | | | | |
|---|---|---|---|---|---|
| 3,847,211 | A | | 11/1974 | Fischel et al. | |
| 4,235,281 | A | * | 11/1980 | Fitch et al. | 165/115 |
| 4,324,844 | A | | 4/1982 | Kothmann | |
| 4,351,797 | A | * | 9/1982 | Bellhouse et al. | 422/48 |
| 5,086,837 | A | * | 2/1992 | Hagemeister | 165/170 |
| 5,411,079 | A | * | 5/1995 | Sasaki et al. | 165/151 |
| 5,469,915 | A | * | 11/1995 | Cesaroni | 165/171 |
| 5,494,099 | A | * | 2/1996 | Chiba et al. | 165/148 |
| 5,636,527 | A | * | 6/1997 | Christensen et al. | 62/476 |
| 5,865,243 | A | * | 2/1999 | Kato | F28D 1/0391 138/115 |
| 6,470,878 | B1 | * | 10/2002 | Brown et al. | 126/110 R |
| 6,918,435 | B2 | * | 7/2005 | Dwyer | 165/171 |
| 7,406,998 | B2 | * | 8/2008 | Kudo | 165/10 |
| 2001/0032716 | A1 | * | 10/2001 | Consilius | 165/80.5 |
| 2009/0126898 | A1 | | 5/2009 | Eplee et al. | |
| 2009/0183862 | A1 | | 7/2009 | Benezech et al. | |

FOREIGN PATENT DOCUMENTS

| | | | | | |
|---|---|---|---|---|---|
| DE | 102005011471 | A1 | | 9/2006 | |
| EP | 0039236 | A1 | | 11/1981 | |
| EP | 1873470 | A2 | | 1/2008 | |
| EP | 2071267 | A1 | | 6/2009 | |
| FR | 1389144 | | | 3/1964 | |
| FR | 1389144 | A | | 2/1965 | |
| FR | 2865028 | A1 | | 7/2005 | |
| JP | 57-134692 | | | 8/1982 | |
| JP | 59-130980 | | | 9/1984 | |
| JP | 09-189494 | | | 7/1997 | |
| JP | 11-108580 | | | 4/1999 | |
| JP | 2004-044881 | | | 2/2004 | |
| JP | 2007518053 | A | | 7/2007 | |
| JP | 2008-275244 | | | 11/2008 | |
| WO | WO 80/00920 | A1 | | 5/1980 | |
| WO | WO 99/53245 | A1 | | 10/1999 | |
| WO | WO 02/090859 | A1 | | 11/2002 | |
| WO | WO2005/073657 | | * | 8/2005 | F28D 9/00 |

OTHER PUBLICATIONS

Office Action corresponding to Mexican Application No. MX/a/2012/005931, issued Jul. 16, 2014.
International Application No. PCT/SE2010/051298, filed Nov. 24, 2010, international search report and written opinion mailed May 31, 2011.
Office Action corresponding to Japanese Application No. 2012-541053, issued Feb. 13, 2015.

* cited by examiner

METHOD OF PRODUCING MULTIPLE CHANNELS FOR USE IN A DEVICE FOR EXCHANGE OF SOLUTES OR HEAT BETWEEN FLUID FLOWS

RELATED APPLICATIONS

This application is a 35 U.S.C. §371 national phase application of PCT Application PCT/SE2010/051298, filed Nov. 24, 2010, which is a continuation-in-part of and claims priority to U.S. application Ser. No. 12/624,612, filed Nov. 24, 2009 now abandoned, and which claims priority to SE 0950889-6, filed Nov. 24, 2009. The entire content of each of these applications is incorporated herein by reference.

FIELD OF INVENTION

The present invention relates generally to exchange of solutes or heat between fluid flows, and more specifically to a method of producing multiple channels for use in a device for exchange of solutes or heat between fluid flows. The invention further relates to a device for exchange of solutes between at least two fluid flows.

BACKGROUND

Today there are many different applications where diffusion is used to enrich a fluid flow with solutes from another fluid flow, or to remove unwanted solutes or substances from the fluid flow. One example is in HVAC (Heating, Ventilation and Air Conditioning) where water vapour can be removed from a gas stream in order to reduce power consumption by reduced condensation in a cooler unit or to recycle energy from exhaust air in e.g. a building. Another example is reverse osmosis for desalinating water.

Different methods are used when it comes to separating water vapour from a fluid; such as rotating wheels with moisture capture or plate heat exchangers with semi permeable membranes. In gas drying technologies bundles of tubing, made of materials like Nafion™ are used.

However, these different methods of removing water vapour from fluids do have certain disadvantages; rotating exchangers are provided with moving parts which cause extra costs for maintenance. Further, rotating exchangers increases the risk of contamination between airstreams. Plate exchangers show low efficiency in regards to enthalpy and Nafion™ tubing is expensive.

Producers of these technologies all try to find the most cost efficient way of producing these effects, and therefore different methods are developed. In conventional plate-based heat- or moisture exchangers, the layers of the exchanger are often made up with spacers or distancing members or a support structure, onto which a membrane is laid. Such structures are common but fail to achieve high cost efficiencies due to their need for spacers, which can become expensive depending on the material used.

Further, the spacers also raise the total weight of the exchanger. Due to the weight, more supports are needed when mounted, and increased weight also increases risks due to handling during maintenance. Also the costs for transportation increase with heavy weight.

In some gas drying technologies a multitude of small tubes are used in order to provide a high moisture exchange surface area coupled with good flow characteristics through the bundles of tubing, while the gas flow characteristics on the outside of the bundle are largely neglected, often without adequate spacing for flow between the tubes.

Tubes in a bundle are usually used in conjunction with another fluid stream that goes in counter- or cross-current to the tubes, but on the outside, between the many tubes.

When using individually made tubes of very small diameter, production cost will become high since small tubes are technically complicated to manufacture and refine into a product, and, as a consequence, the final product will become expensive. Another drawback is when tubes are packed into a bundle; in current contemporary products, no satisfactory space allowance is provided for the flow characteristics in between the tubes.

SUMMARY OF THE INVENTION

The present invention relates to a method of producing multiple channels for use in a device for exchange of solutes between at least two fluid flows overcoming the disadvantages and drawbacks mentioned above. A first and a second sheet are comprised in the device. The method comprises the steps of providing at least one of the first and second sheets with at least one profiled surface, and joining the first and second sheets together. Thereby, channels are formed by the shape of the profiled surface.

The present invention provides a method enabling production of multiple thin channels to a very low production cost. Further, the method provides for an alternative way of manufacturing multiple channels of infinite variation using favourable flow patterns.

According to another embodiment, the method may comprise the further step of providing each of the first and second sheets with at least one profiled surface and joining the first and second sheets together with the profiled surfaces facing against each other, whereby channels are formed by the shape of the profiled surfaces.

According to another embodiment, wherein a plurality of sheets are comprised, the method may comprise the further step of joining the plurality of sheets together, whereby channels in multiple layers are formed by the shape of the profiled surfaces.

According to another aspect of the present invention, a device for exchange of solutes between at least a first and a second fluid flow is provided. The device comprises at least a first and a second sheet wherein the first sheet being provided with at least one profiled surface. The first and second sheets are joined together whereby channels are formed by the shape of the profiled surface.

The device according to the present invention is particularly useful for exchanging a substance from a first fluid flow to a second fluid flow, in order to remove or separate the substance from the first fluid flow.

According to another embodiment, each of the first and second sheet may be provided with profiled surfaces, and the first and second sheet are joined together with the profiled surfaces facing against each other.

According to another embodiment, the sheets may be provided with profiled surfaces mirrored to each other.

According to another embodiment, the cross section of the channels may vary along the length of the device.

According to another embodiment, the number of the channels along the length of the device may vary.

According to another embodiment, the device may further comprise a plurality of sheets stacked in multiple layers.

According to another embodiment, the sheet material may have a high solubility to water.

According to another embodiment, the sheet material may have a pore size between 0.1-50 nanometers.

According to another embodiment, the sheet material may have a pore size of 50-500 nanometers.

According to another embodiment at least one of the sheets may be hydrophobic.

According to another embodiment at least one of the sheets may be hydrophilic.

According to yet another embodiment at least one of the sheets may be a metal.

In one embodiment, each of said first and second sheet may have a first end portion and a second end portion, said first and second end portions having sloping intermediate surfaces between each channel, said sloping intermediate surfaces being inclined in a direction towards a middle portion of the respective sheet.

In one embodiment, each sheet may have a first lateral end portion and a second lateral end portion opposite said first lateral end portion, said first lateral end portion having a greater lateral extension than said second lateral end portion.

The high exchange surface area provided by a multitude of channels, coupled with good flow characteristics between layers provides an ideal situation for diffusion transfer or heat transfer between fluid streams.

The present design allows for any distance between layers according to needs. The flow characteristics between layers can also be adjusted by increasing the distance between layers or staggering the layer layout.

A further advantage is, for example in the case that a fluid is to be dried, that a larger stream of air may be flowing outside the channels, or between layers in the embodiments provided with more than one layer, whereby the fluid inside the channels is more effectively dried. By suitable design of the distance between layers, the amount of flow between layers may be optimised for the application.

The present invention provides a device allowing for a counter current design with a tight configuration and no need for separate spacer material to allow flow across the sheets. Further, the device provides exceptionally good flow characteristics between layers due to its design with multiple channels and stacked layer design with adjustable distance between layers. Also, the integrated channels provide low maintenance and low risk of tear since there is no wear due to vibrations of the sheets against support structures.

Yet a further advantage is that the device is cheap to manufacture with automatic separation of individual channels and with good and independently adjustable outside flow characteristics. Further, the present invention provides a device for solute exchange that eliminates the need for additional support structures between sheets while at the same time providing a means for counter current flow, which improves the efficiency significantly compared to conventional technology.

Further preferred embodiments are defined by the dependent claims.

BRIEF DESCRIPTION OF DRAWINGS

The invention is now described, by way of example, with reference to the accompanying drawings, in which.

DETAILED DESCRIPTION OF PREFERRED EMBODIMENTS

Figure 1:
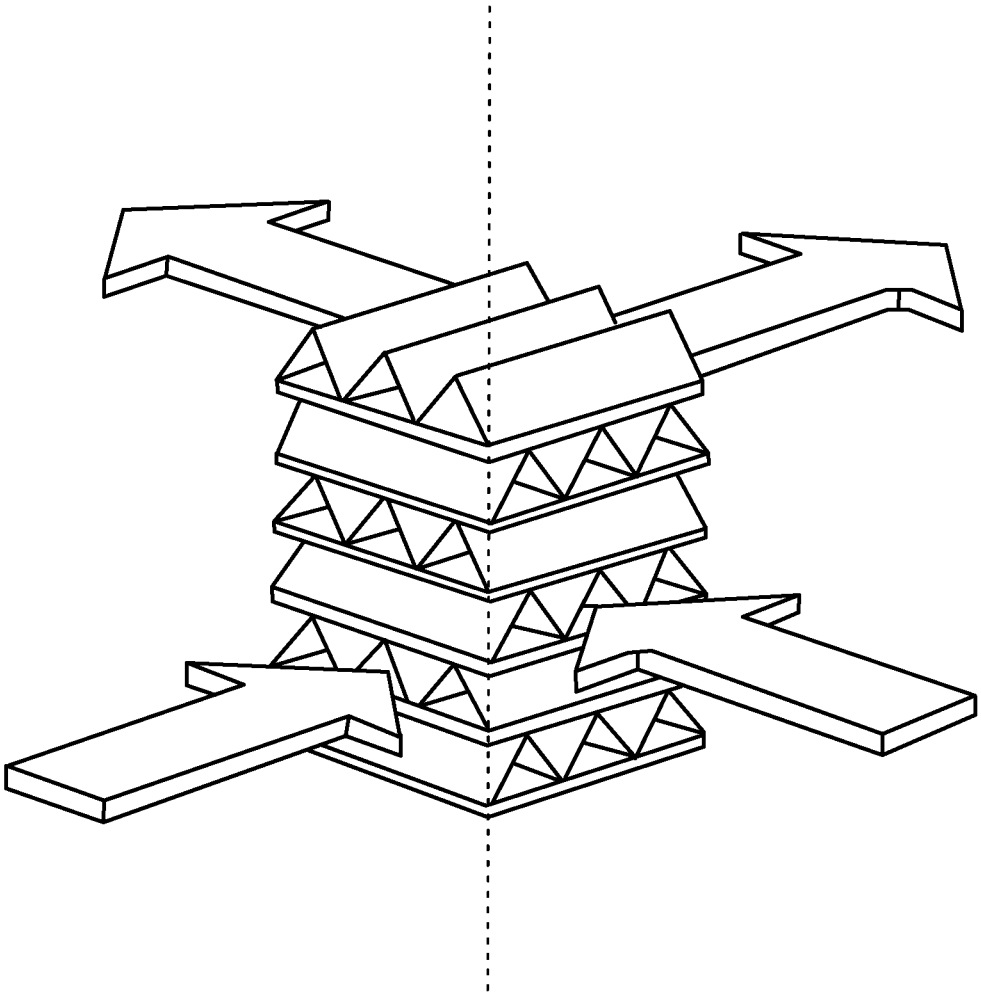
FIG. 1 shows a device for exchange of water vapour according to prior art.

FIG. 1 shows a device for exchange of water vapour according to prior art. In conventional technology, a corrugated material or a flow distribution member is used between plain sheets of permeable material to define channels and flow direction and to provide a uniform spacer for separating layers. In some examples the sides of the sheets are turned down to provide spacers. This design is always limited to a cross flow configuration.

Figure 2:
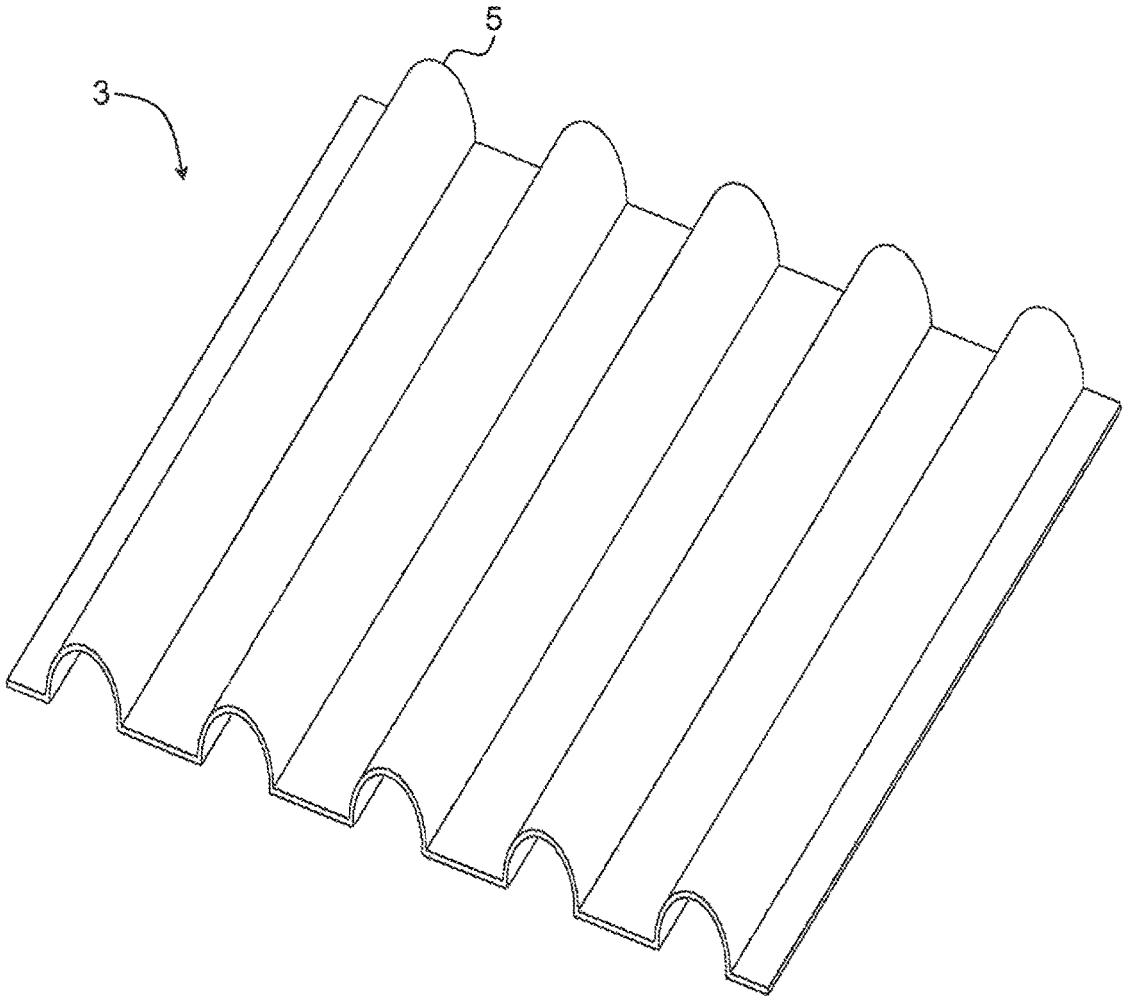
FIG. 2 shows a sheet with a profiled surface according to one embodiment of the present invention.

FIG. 2 shows a sheet 3 with a profiled surface 5 according to the present invention. To create the shape of the profiled surface 5 several different methods may be used in manufacturing. For example, the sheet can be a corrugated plate. As a further example, a sheet of a material can be heated to a degree where it is deformable and then cooled after shaping it over a mould/body and thereby letting the shape set. Once deformed permanently, the shape will stay. Another way is to let a lot of extremely thin threads fall randomly over a mould/body e.g. through electro spinning, to produce a shape that, once it sets, keeps its shape even when deformed. Yet another way to create the shape of the profiled surface 5 is to cut channels with favourable flow patterns into one side, or both sides, of a sheet of a solid or porous material. The material of the sheets 3, 4 may be semi permeable, or permeable to certain substances or solutes. The material of the sheets may be either porous or solid or both.

The methods described above are especially suitable when the dimension of the channels 1 is small. With those methods small channels with a cross section of only a few millimeters may be produced easily and cost efficiently.

The shape of the profiled surface, and thus the cross section of the channels formed by the surfaces, may vary, depending on desired flow characteristics. The cross section of the channels may for example be circular, hexagonal, square or triangular. A first and a second fluid may flow counter-current to each other, inside and outside of the channel 1 respectively.

The fluids in the channels may be a gas or a liquid.

Figure 3:
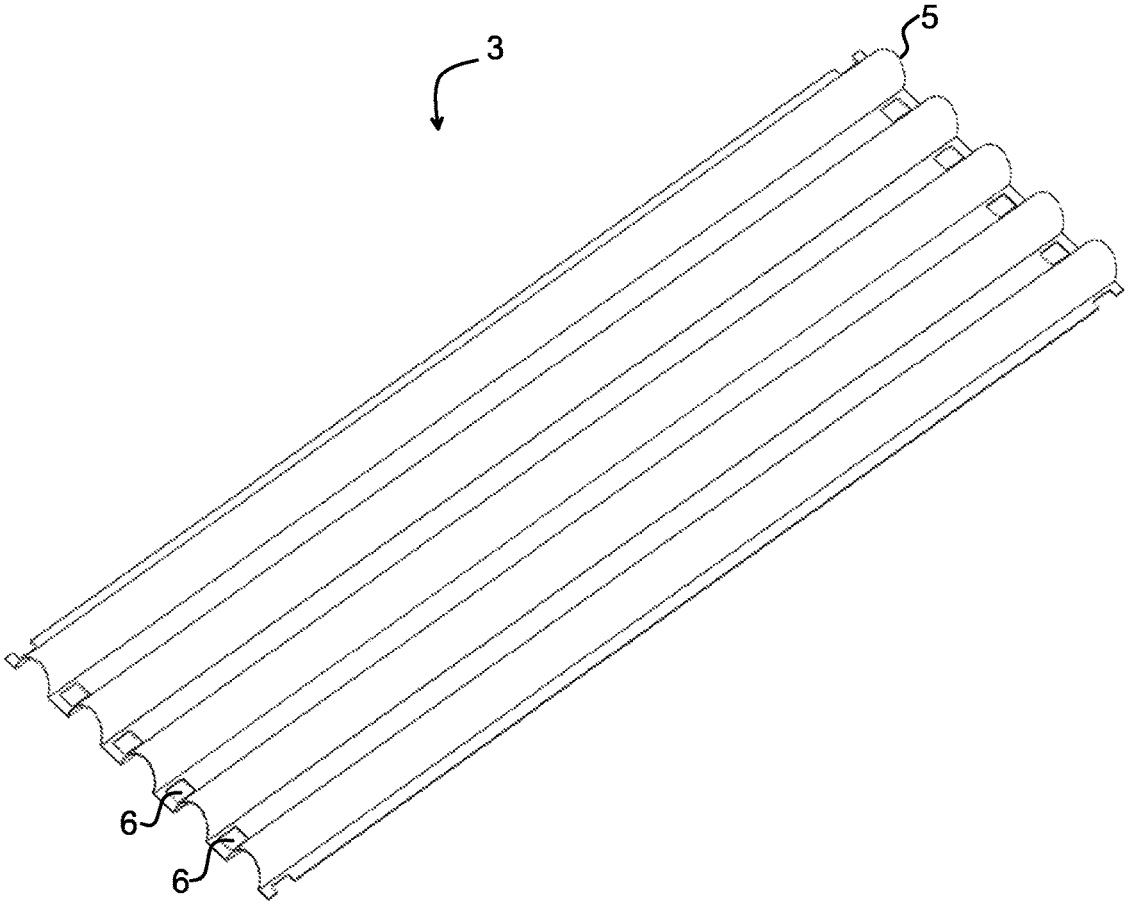
FIG. 3 shows a sheet with a profiled surface according to another embodiment.

FIG. 3 shows another sheet 3 with a profiled surface 5 according to one embodiment of the invention. The sheet is further provided with openings to facilitate flow between layers 7 when a plurality of sheets are joined together in multiple layers 7.

Figure 4:
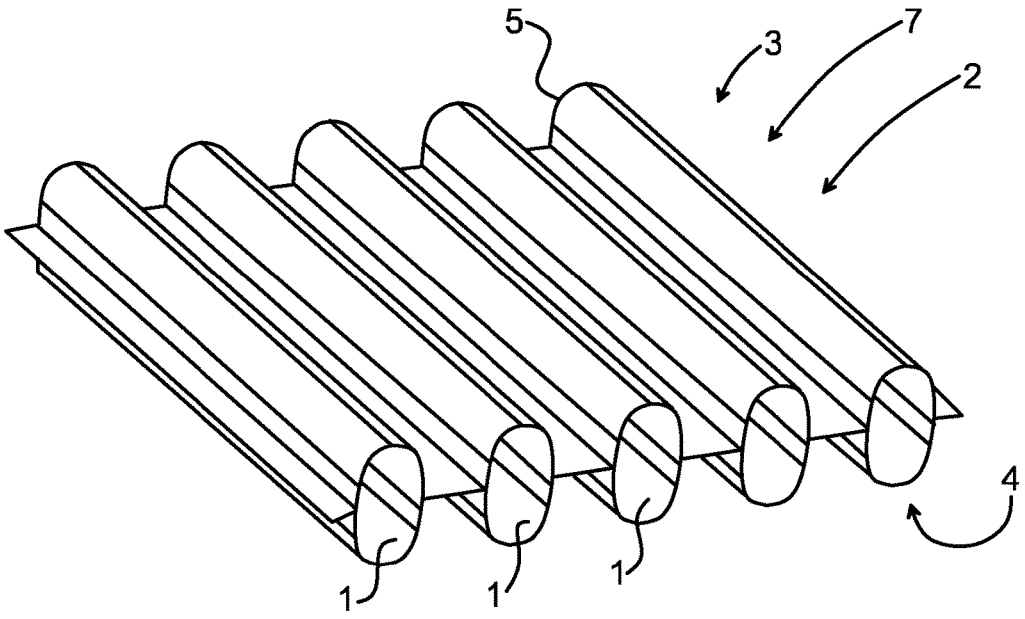
FIG. 4 shows two sheets with profiled surfaces joined together according to one embodiment of the present invention.

FIG. 4 show two sheets 3, 4 with profiled surfaces 5 joined together according to the present invention. By providing a sheet of a base material with a profiled surface 5, for example as shown in FIG. 1, and by joining two such sheets 3, 4 of opposite and preferably mirrored configured profiled surfaces 5 to each other, a multiple of small channels 1 can be formed by an easily automated process. Joining the sheets 3, 4 together may be achieved by for example welding, gluing or fusing, or any other suitable adhesive process that would join the two profiled plates hermetically together. The sheets 3, 4 are provided with a profiled surface 5 whereby channels 1 with circular cross-sections are achieved. The channels 1 may have any other suitable shape, for example oval, hexagon or square.

Figure 5:
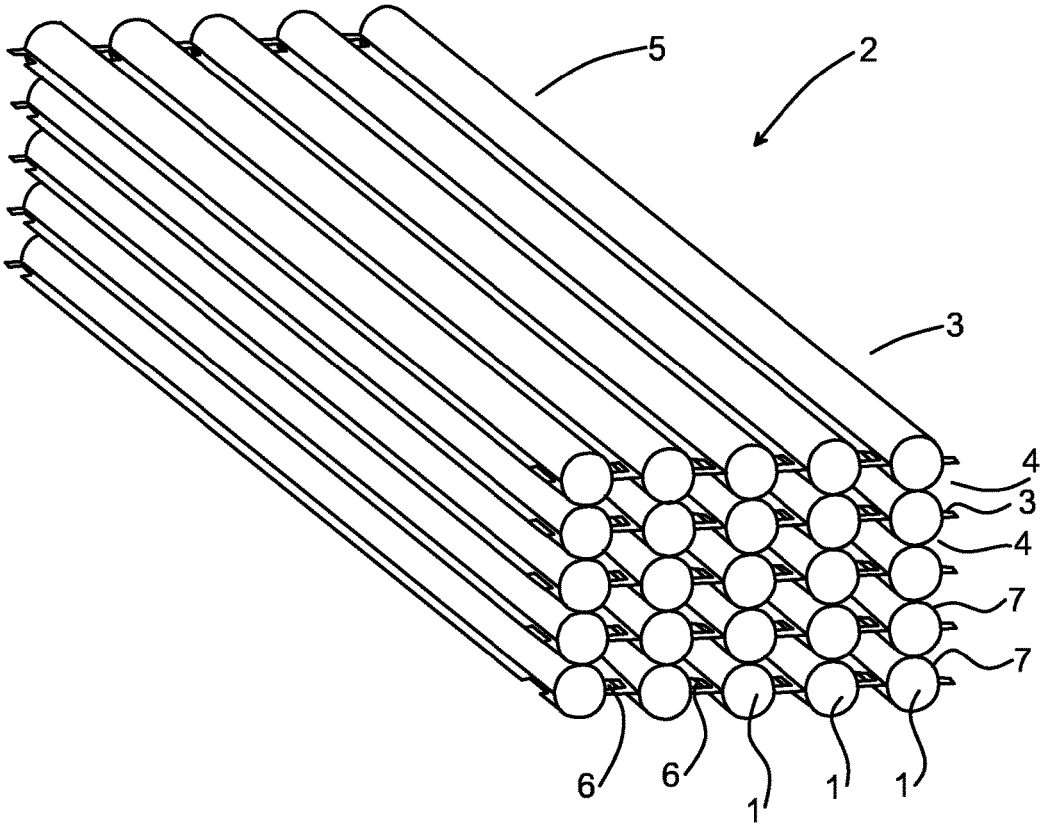
FIG. 5 shows a plurality of sheets with profiled surfaces joined together.

FIG. 5 shows a plurality of sheets 3, 4 joined together. When stacked, as shown in the figure, the sheets 3, 4 form multiple layers 7. Such a configuration results in a low pressure drop when fluids flow from one side to the other, thereby securing and maintaining the flow characteristics of the channels and an unobstructed fluid flow between the layers 7, outside the channels 1.

Figure 6:
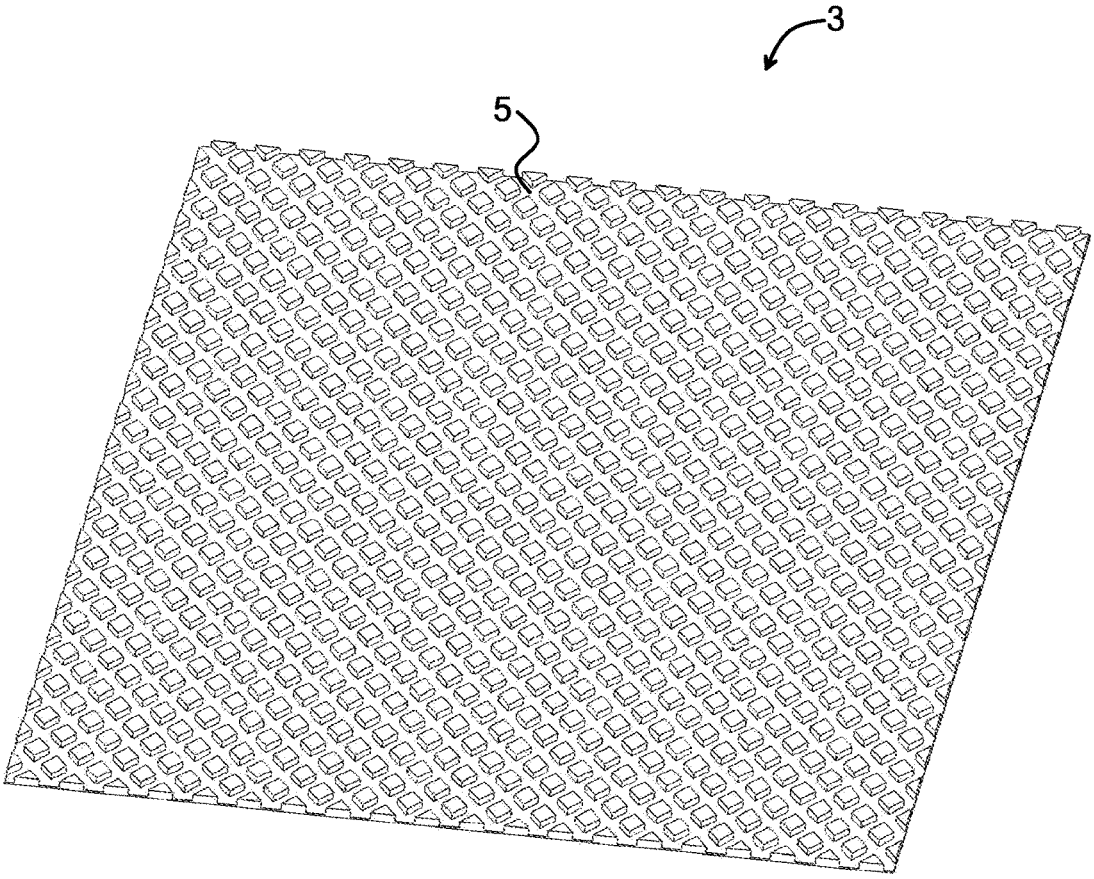
FIGS. 6 and 7 show sheets with alternative profiled surfaces.
Figure 7:
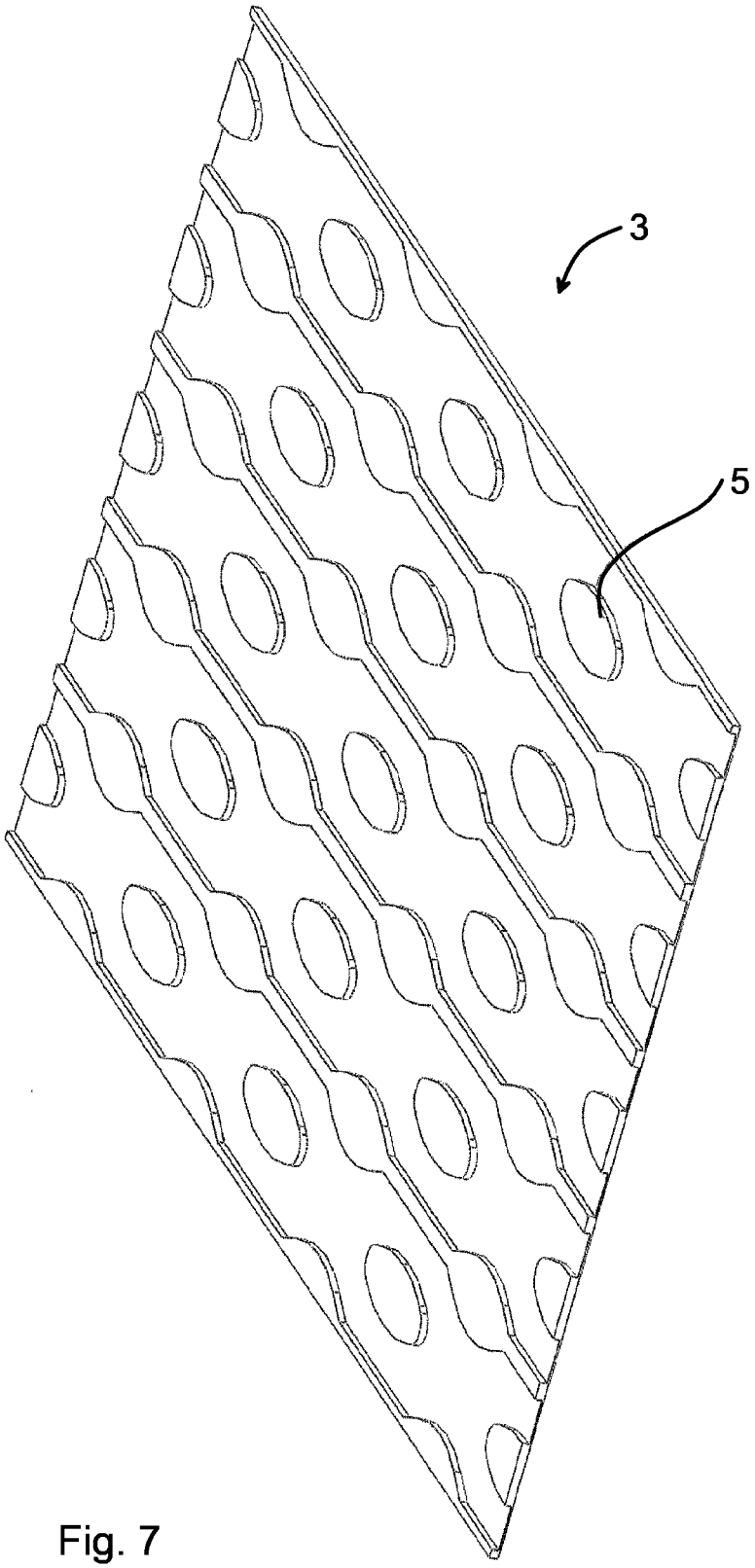

FIGS. 6 and 7 show sheets 3 with alternative profiled surfaces 5.

Figure 8:
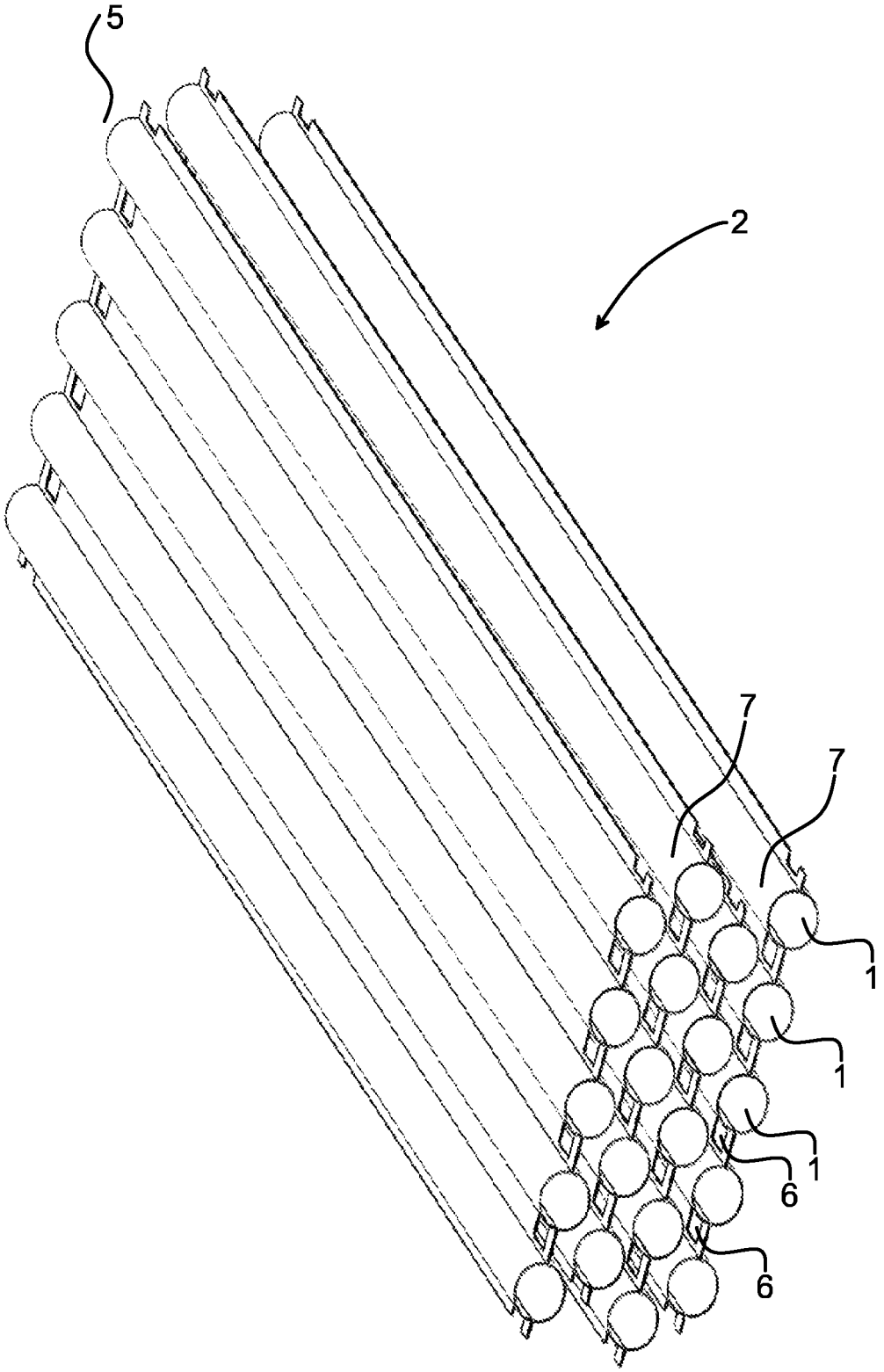
FIG. 8 shows a plurality of sheets joined together in staggered layers.

FIG. 8 shows a plurality of sheets 3, 4 joined together in multiple layers 7. The layers 7 are displaced in relation to each other whereby a device with plurality of layers 7 with a staggered configuration is provided. A staggered formation reduces distance between layers 7 and thus increases the total surface area per volume unit of the configuration, and the unit can thus be made more compact while maintaining the same surface area.

Figure 9:
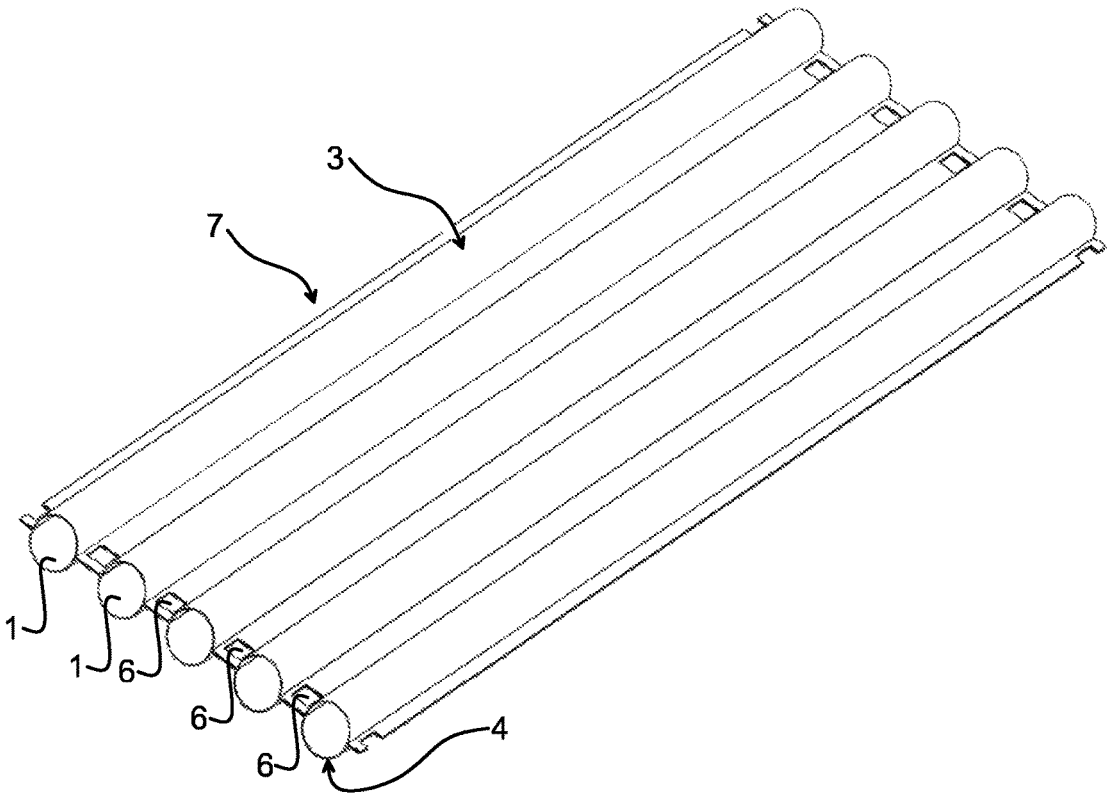
FIG. 9 shows two sheets with profiled surfaces joined together according to yet another embodiment of the present invention.

FIG. 9 shows two sheets with profiled surfaces joined together.

Figure 10:
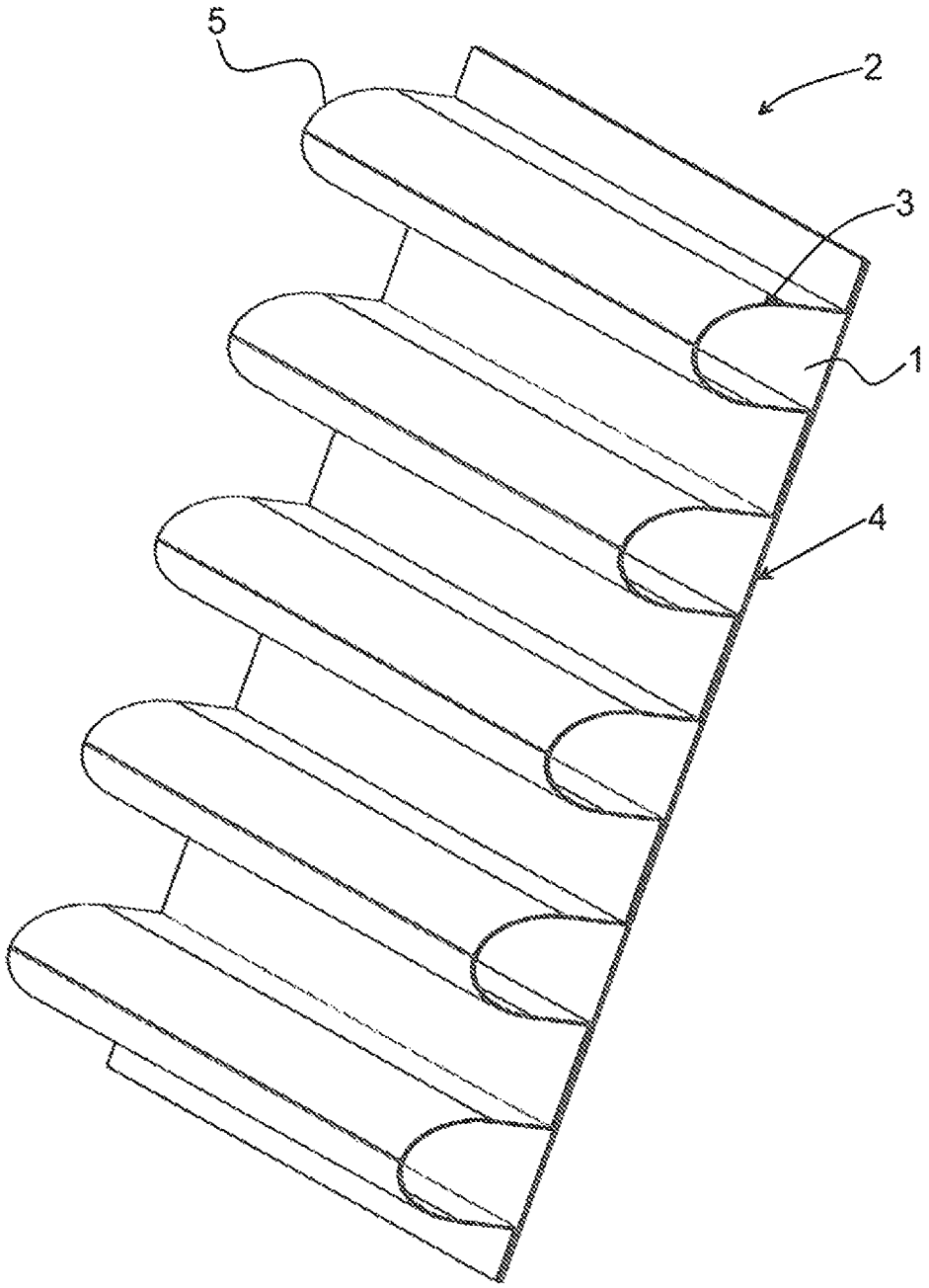
FIG. 10 shows one sheet with profiled surfaces joined together with a sheet with a smooth surface according to one embodiment of the present invention.

FIG. 10 shows one sheet 3 with profiled surfaces 5 joined together with a sheet with a smooth surface. Thereby, channels 1 showing a half-circular cross-section is provided.

Figure 11:
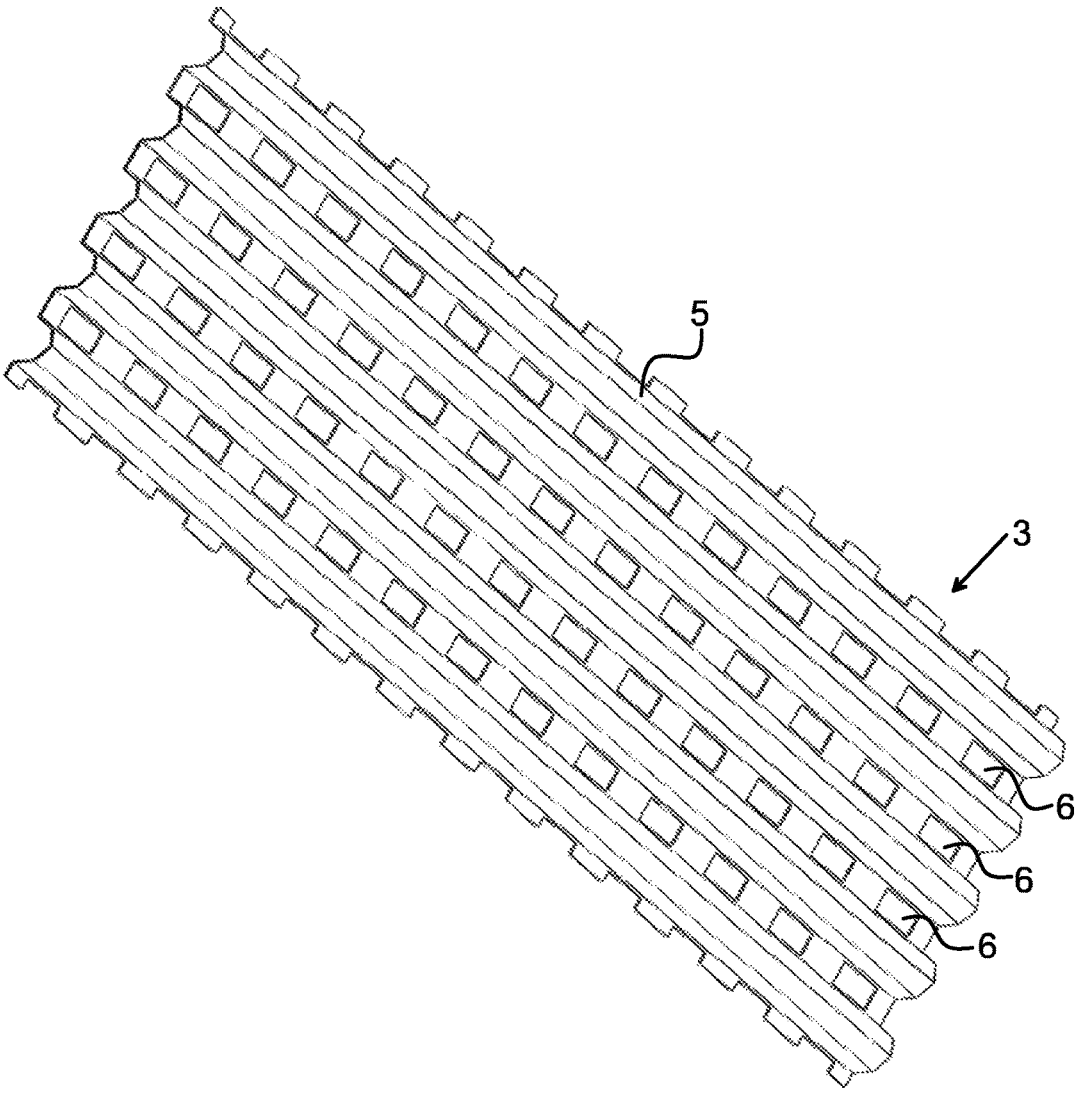
FIG. 11 shows a sheet with yet another alternative profiled surface.

FIG. 11 shows a sheet with an alternative profiled surface 5. The sheet is also provided with a plurality of openings 6 to facilitate flow between layers 7 when a plurality of sheets 3, 4 are joined together in multiple layers 7.

In order to separate the entry of flows, openings can be cut between the channels. This provides entry channels perpendicular to the main direction of the channels, thereby separating the flow outside the channels, or, in the case of multiple layers, between layers, from the entry point of the flow inside the channels. If the configuration of multiple layers 7 is staggered, the same method may be used for a diagonal channel, perpendicular to the channels to feed the flow between layers 7.

The profiled surfaces 5 may be formed by any suitable method, for example by heating the sheets, deforming them whereby the surfaces are profiled, and then cooling them whereby the shape of the profiled surfaces stay in their deformed shape. Another example is letting a plurality of thin threads fall randomly over a body with a profiled surface, whereby a sheet with a profiled surface 5 is created that, once set, will keep its shape. Further alternative may be cutting channels into one side, or both sides, of a first and a second sheet of a solid or porous material. Yet further the profiled surface may be provided by applying a pattern of a plastic or other suitable material on sheets.

Further, openings 6 can be cut between the channels 1 in order to provide an inlet that distributes flow from a direction perpendicular to the channels 1, in between layers 7. This provides unobstructed flow perpendicular to the main direction of the channels, thereby separating the flow between the channels from the entry point of the flow inside the channels. If the configuration of layers 7 is staggered, the same method may be used for a diagonal channel, perpendicular to the channels to feed the flow between layers 7.

In order to distribute flows evenly and easily between layers 7, openings 6 can be cut either between the ends of the channels (primarily for flow distribution), or in intervals along the whole length of the channels, providing a simple means for pressure equalization and easy flow path.

In order to provide a bundle of channels for cross flow or counter current flow, uniformly spaced openings can be cut between channels to provide for an unobstructed flow between channels between channels from two directions (top to bottom or side to side), both perpendicular to the main direction of flow inside the channels.

Any of the above described embodiments may be utilized in either moisture exchange applications, for exchange of solutes or alternatively, in heat exchange applications. The functionality of an embodiment depends on the material in which the sheets are manufactured.

For heat exchange applications, a material with high heat conductivity may typically be used. Such materials include metals such as aluminium and stainless steel, or thermoplastics such as polypropylene or polyethylene terephthalate (PET). For applications involving exchange of solutes, typically a permeable or semi-permeable material as described hereabove may be utilized.

FIG. 12 a shows a perspective of a sheet 10 according to an example of the present invention. The sheet 10 may be manufactured in any way as already described above. The sheet may be used in either moisture exchange applications, for exchange of solutes or alternatively, in heat exchange applications. As mentioned above, the particular application depends on the material of the sheet 10.

The sheet 10 has a first end 10-1 and a second end 10-2 opposite the first end 10-1. The sheet 10 has a plurality of channels 12 presenting a profiled surface of the sheet 10.

The sheet 10 further has a first lateral portion 14-1 and a second lateral portion 14-1 opposite the first lateral portion 14-1. The first lateral portion 14-1 and the second lateral portion 14-2 form outer boundaries of the sheet 10 in the longitudinal direction thereof.

Sheets 10 may pairwise be joined together with corresponding channels 12 facing each other, wherein corresponding channels 12 thereby form closed channels or tubes.

Figure 12A:
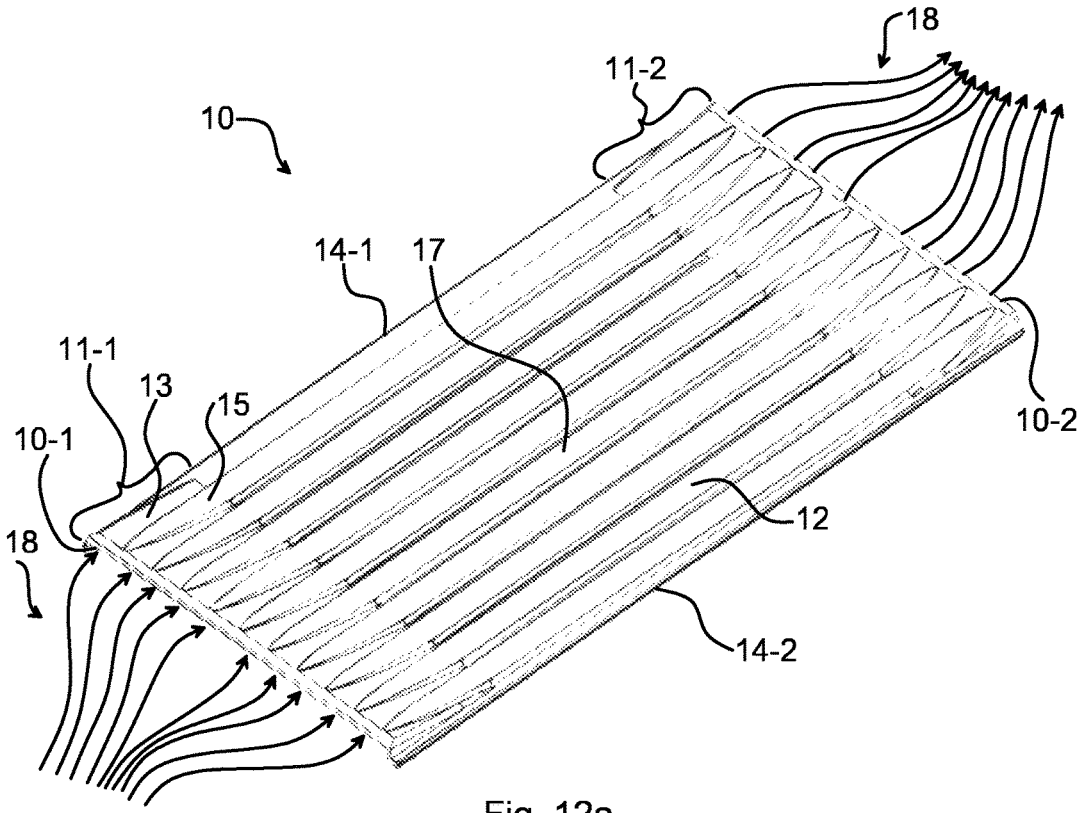
FIG. 12*a* shows a perspective view of an example of a sheet for use in an exchange device according to the invention.
Figure 12B:
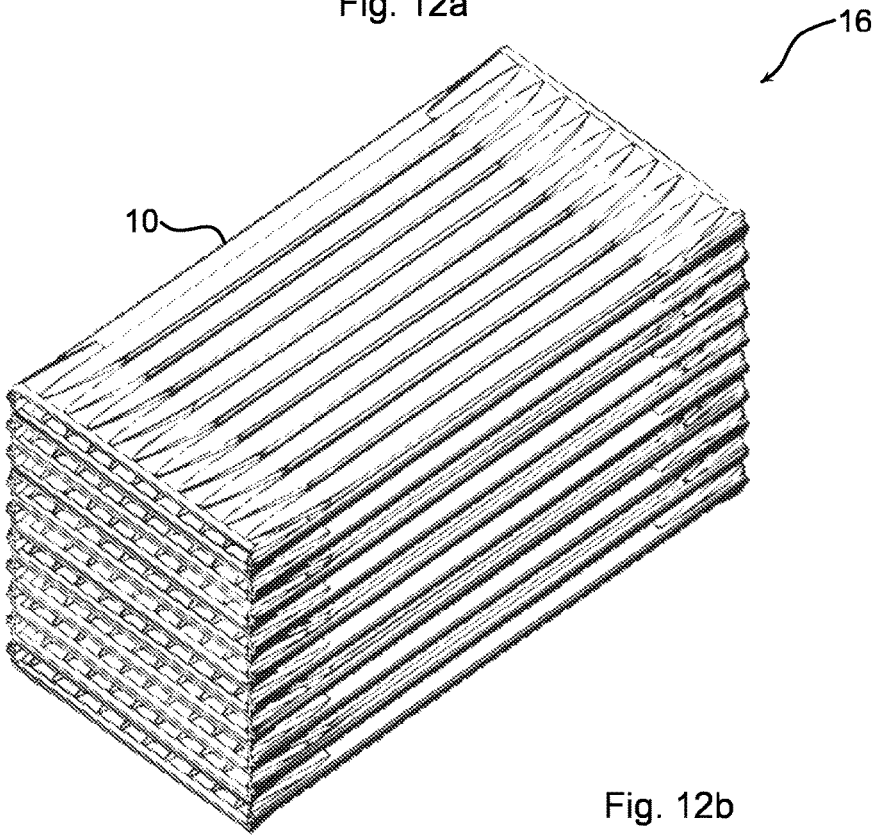
FIG. 12*b* shows a perspective view of a stack of sheets as shown in FIG. 12*a*, forming part of an exchange device according to the invention.
Figure 15:
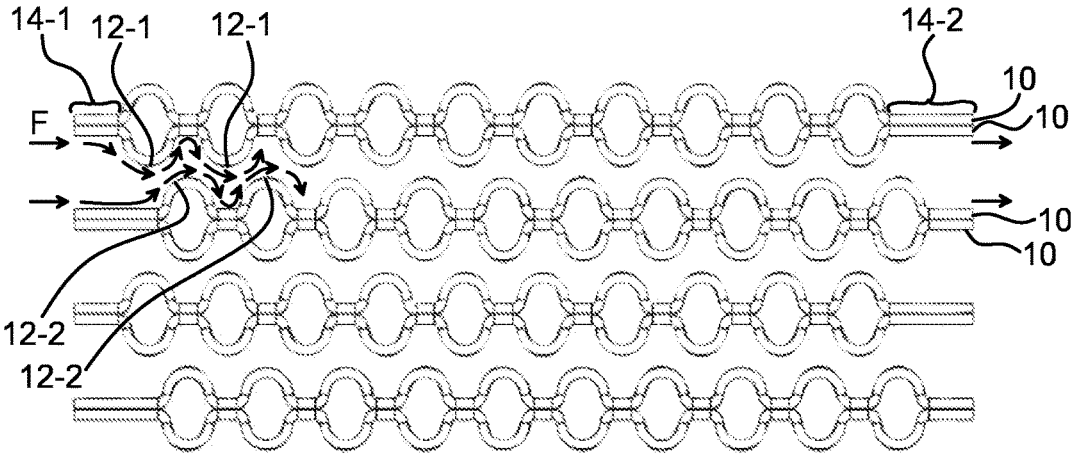
FIG. 15 shows a cross-sectional view of a stack of sheets, illustrating the flow of a fluid in a direction perpendicular to the longitudinal extension of the sheets.

Sheets 10 may pairwise be assembled to form a stacked sheet assembly 16, as shown in FIG. 12*b* and schematically shown in FIG. 15. The stacked sheet assembly forms multiple channels 12 through which a first fluid may flow. In layers between each pair of sheets 10, a second fluid may flow. The second fluid is typically provided into the stacked sheet assembly 16 from a side defined by the first lateral portion 14-1. The second fluid flow typically exits the stacked sheet assembly 16 from a side defined by the second lateral portion 14-2. While the second fluid is flowing through the stacked sheet assembly 16, it may flow both parallel with the channels 12, and perpendicular to the channels 12.

In case the stacked sheet assembly is arranged such that it allows for fluid flow of the second fluid parallel with the channels 12, the flow direction is typically in a direction opposite the flow direction of the first fluid which flows through the channels 12. However, the fluid flow of the first and the second fluids may also be in the same direction in some applications.

The first lateral portion 14-1 and the second lateral portion 14-2 present substantially planar surfaces.

The first lateral portion 14-1 may have a greater lateral extension $d_1$ from an outmost channel 12 from which it extends, compared to a lateral extension $d_2$ of the second lateral portion 14-1 with respect to the extension of the second lateral portion 14-2 from an outmost channel 12 from which it extends, as shown in FIG. 15.

By providing a sheet 10 with a configuration where the first lateral portion 14-1 has a greater lateral extension $d_1$ from an outmost channel than the lateral extension $d_2$ of the second lateral portion 14-2, pairs of joined sheets 10 may be stacked such that the channels 12 for each pair of sheet is arranged in an alternating manner. This way, every second layer of sheet pairs have their channels in mutual planes. Thereby, fluid flow may pass between each pair of sheet 10 in a direction from the first lateral portion 14-1 to the second lateral portion 14-2.

The sheet 10 shown in FIG. 12*a* has a first end portion 11-1 at its first end 10-1. The sheet 10 has a second end portion 11-2 at its second end 10-2. The first end portion 11-1 and second end portion 11-2 have a plurality of sloping intermediate surfaces 13. A sloping intermediate surface 13 is provided between each adjacent channel 12. The sloping intermediate surfaces 13 are substantially level with an outer top surface 15 of the channels 12 at the first end 10-1 and the second end 10-2.

The sloping intermediate surfaces 13 have a downwardly inclination from the first end 10-1 and the second end 10-2 in a direction towards a middle portion 17 of the sheet 10. Between the first end portion 11-1 and the second end portion 11-2, the intermediate surfaces between the channels 12 are substantially parallel with the channels 12.

The sloping intermediate surfaces 13 provide open ends for each pair of joined sheet 10 as no channels are formed at the first end 10-1 and second end 10-2. Thereby, the first end portion 11-1 and the second end portion 11-2 act as flow distribution members, evenly distributing incoming fluid flow 18 into the plurality of joined channels 12 at the first end 10-1, and collecting the flow from each channel 12 at the second end 10-2. This process is schematically illustrated in FIG. 12*a*.

Further, the sloping intermediate surfaces which are substantially in level with the top surfaces 15 of channels 12 at the first end 10-1 and the second end 10-2 provide a distancing element so that stacked pairs of sheets 10 may be properly distanced. Thereby fluid flow between each layer of joined pair of sheets 10 may be obtained. The distancing will appear only at the first end portion 11-1 and the second end portion 11-2. Fluid flow may hence be provided unobstructed in the area between the first end portion 11-1 and the second end portion 11-2. However, it is envisaged that other separating means may be provided along the axial extension of the sheet, if the sheet are very long, in order to separate pairs of sheet from each other.

Figure 13:
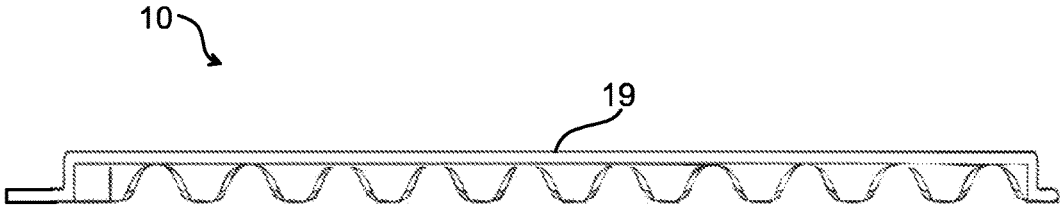
FIG. 13 shows a front view of the sheet in FIG. 12*a*.
Figure 14:
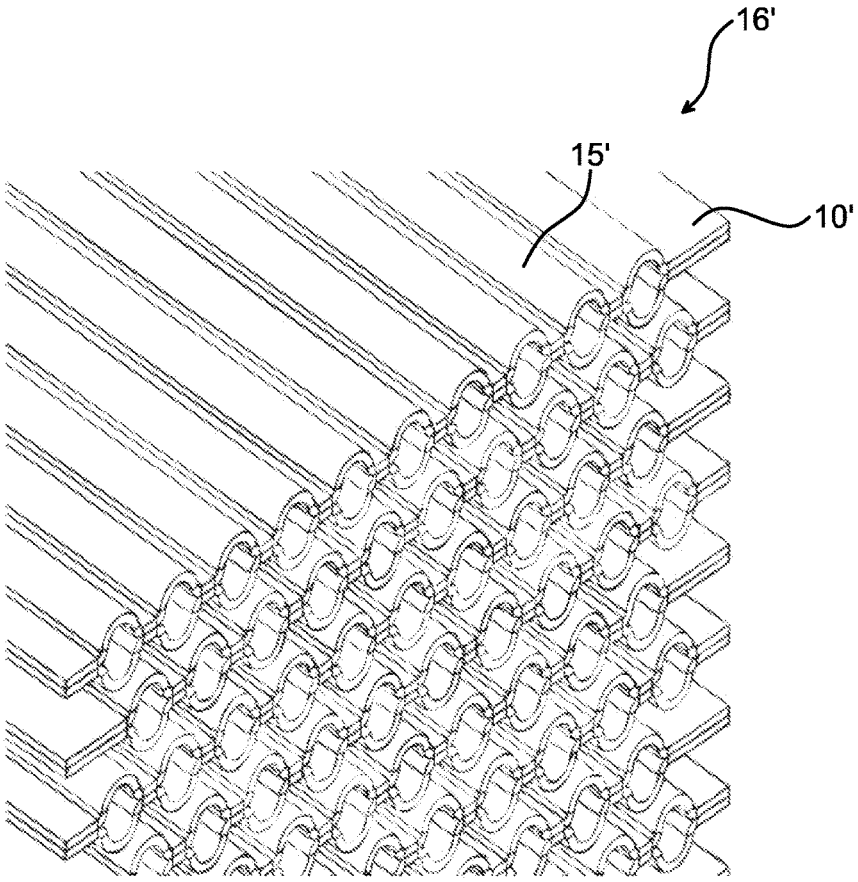
FIG. 14 shows a perspective view of a stack of sheets forming part of an exchanging device according to another example of the invention.

FIG. 13 shows a front view of the sheet 10. A flat surface 19 allows the stacking of multiple pairs of sheet 10 while distancing each pair properly from its two adjacent pairs of sheet 10. FIG. 14 shows a stacked sheet assembly 16', which is a variation of the stacked sheet assembly 16. Generally, the stacked sheet assembly 16' has similar design as that of stacked sheet assembly 16. However, sheet 10' utilizes other techniques than the above-described sloping intermediate surfaces for distancing each pair of joined sheet 10'. In particular, each pair of joined sheets 10' may be stacked with other joined pair of sheets 10' by e.g. providing a string of hot-melt adhesive transversally across an outer surface 15' of a first and a second end of each sheet 10'. Another alternative is to provide distancing members at each end.

FIG. 15 illustrates how fluid flows transversally across a part of the stacked sheet assembly 16. A fluid flow F between only two pairs of joined sheet 10 is shown for illustrative purposes.

As the fluid flow F enters the stacked sheet assembly 16, laminar flow becomes turbulent. This effect is partly due to the downwardly protruding channel portions 12-1 which direct the fluid flow F towards the upwardly protruding channel portions 12-2. The fluid flow will thereby have a more even velocity gradient, resulting in turbulent flow and a low pressure fall across the stacked sheet assembly 16. Hence, the flow speed may substantially be maintained throughout the stacked sheet assembly 16. Further, due to the nature of resulting turbulent flow, the reduced boundary layer resistance result in more efficient exchange with the first fluid flowing in the channel 12. Thereby very efficient cooling or heating may be provided.

It is to be noted that words such as "upwardly" and "downwardly" only reflect the geometrical layout of the stacked sheet assembly in FIG. 15 and is not to be construed as limiting said features in this manner. In reality, the directions in which the channels protrude depend on the orientation of the stacked sheet assembly.

The fluids flowing through the stacked sheet assembly 16 may be any gas, or any liquid suitable for applications exchanging solutes and/or heat. The sheet may be constructed from any suitable material, depending on the application, e.g. for exchanging solutes, or for cooling or heating purposes.

The invention has mainly been described above with reference to a few embodiments. However, as is readily appreciated by a person skilled in the art, other embodiments than the ones disclosed above are equally possible within the scope of the invention, as defined by the appended patent claims. For instance, a sheet may have a first end and a second end which are not opposite each other; the sheet may have other shapes than being rectangular. For instance, the sheet may have a rhomboid shape, or being formed as a 'U'.

The invention claimed is:

1. Method of producing multiple channels for use in a device for exchange of solutes or heat between at least a first and a second fluid flow, wherein the device comprises at least a first and a second sheet, the method comprising:

providing each of said first and second sheets with at least one profiled surface, joining said first and second sheets together with the at least one profiled surface facing each other, whereby channels having a constant height along their entire longitudinal extension are formed by the shape of the at least one profiled surface, wherein each of said first and second sheet has a first end portion and a second end portion, said first and second end portions having sloping intermediate surfaces between each channel, wherein the sloping intermediate surfaces are level with an outer top surface of the channels at a first end of the first end portion and a second end of the second end portion, wherein each sloping intermediate surface is inclined relative to the longitudinal extension of the channels until reaching a planar longitudinally extending portion between the first end portion and the second end portion, and wherein the sloping intermediate surfaces have a greatest lateral extent at the first and second ends and narrow to a lesser lateral extent at the planar longitudinally extending portion between the first and second end portions.

2. Method according to claim 1, wherein the at least a first and second sheets are a plurality of sheets, the method comprising joining said plurality of sheets together, whereby channels in multiple layers are formed by the shape of the profiled surfaces.

3. Device for exchange of solutes or heat between at least a first and a second fluid flow, the device comprising:

at least a first and a second sheet, each of said first and second sheet comprising profiled surfaces, wherein said first and second sheets are joined together with said profiled surfaces facing each other, whereby channels having a constant height along their entire longitudinal extension are formed by the shape of the profiled surfaces, wherein each of said first and second sheet has a first end portion and a second end portion, said first and second end portions having sloping intermediate surfaces between each channel, wherein the sloping intermediate surfaces have a widest entire lateral extent at the first and second end portions and a narrowest entire lateral extent toward a middle portion of the sheets between the first and second end portions, wherein the sloping intermediate surfaces are level with an outer top surface of the channels at a first end of the first end portion and a second end of the second end portion, and wherein each sheet has a first lateral end portion and a second lateral end portion opposite said first lateral end portion, said first lateral end portion having a greater lateral extension than said second lateral end portion.

4. Device according to claim 3, wherein said sheets with profiled surfaces are mirrored to each other.

5. Device according to claim 3, wherein the cross sections of said channels varies along the length of the device.

6. Device according to claim 3, wherein the at least a first and a second sheet are a plurality of sheets stacked in multiple layers.

7. Device according to claim 3, wherein the at least a first and a second sheet have a sheet material that has a high solubility to water.

8. Device according to claim 3, wherein the at least a first and a second sheet have a sheet material that has a pore size between 0.1-50 nanometers.

9. Device according to claim 3, wherein the at least a first and a second sheet have a sheet material that has a pore size of 50-500 nanometers.

10. Device according to claim 3, wherein at least one of the at least a first sheet and a second sheet is hydrophobic.

11. Device according to claim 3, wherein at least one of the at least a first sheet and a second sheet is hydrophilic.

12. Device according to claim 3, wherein at least one of the at least a first sheet and a second sheet is a metal.

* * * * *